US006491303B1

(12) United States Patent
Huston

(10) Patent No.: US 6,491,303 B1
(45) Date of Patent: Dec. 10, 2002

(54) PORTABLE TARGET

(76) Inventor: James J. Huston, P.O. Box 144, Hawthorne, NV (US) 89415-0144

( * ) Notice: Subject to any disclaimer, the term of this patent is extended or adjusted under 35 U.S.C. 154(b) by 0 days.

(21) Appl. No.: 09/525,212

(22) Filed: Mar. 14, 2000

Related U.S. Application Data

(60) Provisional application No. 60/124,332, filed on Mar. 14, 1999.

(51) Int. Cl.[7] ..... F41J 1/10
(52) U.S. Cl. ..... 273/407
(58) Field of Search ..... 273/403–410

(56) References Cited

U.S. PATENT DOCUMENTS

| | | | | | |
|---|---|---|---|---|---|
| 1,364,010 | A | * | 12/1920 | Tyerman | 273/407 |
| 1,547,222 | A | * | 7/1925 | Lynch | 273/407 |
| 3,355,174 | A | * | 11/1967 | Hutson | 273/407 |
| 3,512,778 | A | * | 5/1970 | Allen | 273/404 |
| 4,691,925 | A | | 9/1987 | Scholem | |
| 4,726,593 | A | * | 2/1988 | Wade | 273/407 |
| D329,665 | S | | 9/1992 | Carroll | |
| 5,676,378 | A | | 10/1997 | West | |
| 5,829,753 | A | * | 11/1998 | Wiser | 273/407 |
| 5,938,203 | A | * | 8/1999 | Bechwith, Sr. | 273/407 |
| 5,947,477 | A | * | 9/1999 | Turnipseed | 273/407 |

FOREIGN PATENT DOCUMENTS

| | | | | |
|---|---|---|---|---|
| GB | 2079164 | * | 1/1982 | 273/407 |
| WO | 90/15964 | * | 12/1990 | 273/407 |

OTHER PUBLICATIONS

Jim Carmichel, "Carmichel's Target Stand", Outdoor Life, May, 1992, vol. 189, No. 5, pp 61–62.

* cited by examiner

*Primary Examiner*—Mark S. Graham
(74) *Attorney, Agent, or Firm*—Kenehan & Lambertsen, Ltd; John C. Lambertsen

(57) ABSTRACT

A firearm target support utilizes a wooden support frame and separate removable footings for ease in transport and storage. The frame includes a pair of support legs to which the footings are attached when deploying the target support. For storage, each of the footings is removed from the terminus of the support legs, and is attached in a linear manner to the support legs at another location. In this manner, the footings project fore and aft of the support frame to enhance target stability when the target support is deployed, and run lengthwise along the support legs when stored. The replaceable target can either be received directly by the opposed support legs, using grooves formed therein, or it can be received in a separate target frame, which in turn is received between the opposed support legs.

6 Claims, 4 Drawing Sheets

PORTABLE TARGET

CROSS-REFERENCE TO RELATED APPLICATION

This application claims the benefit of U.S. provisional application, Ser. No. 60/124,332, Filed Mar. 14, 1999.

BACKGROUND OF THE INVENTION

1. Field of the Invention

The present invention relates in general to firearm targets and, more particularly, to target supporting structures. More specifically, the present invention relates to a target support that can be readily disassembled for transport and storage, and subsequently reassembled at a suitable location for deployment.

2. Description of the Prior Art

Recent years have shown an increasing popularity in the recreational use of firearms. With the associated costs of wild game hunting spiraling ever upwards, gun owners in even rural areas have turned towards rifle and pistol ranges when it comes time to use their weapon.

In many of these outdoor ranges, convenient supporting structures from which to hang targets are simply not available. As a result, shooters will often attach their targets to pasteboard boxes, slabs of scrap wood, and all types of odd materials that they may have brought to the range. The less-prepared shooters will resort to aiming at cans, bottles, plastic jugs or whatever other refuse they can salvage from nearby garbage containers.

What might not prove a problem when only occasionally done on a dispersed basis in open fields has become a disaster when such activity is concentrated in the narrow confines of a shooting range. Under constant bombardment, the shooting range is covered with shards of broken glass, shredded plastic, and torn-up remains of boxes and cans. Even the periodic efforts of volunteer cleanup crews do not prevent a shooting range from taking on the appearance of a disaster movie set.

The lack of dependable target supports also hurts the more serious shooter. Having invested perhaps hundreds of dollars in a first-class rifle (and scope), and then spending dozens of hours at a loading bench carefully manufacturing the ammunition, it almost seems pointless to then take careful aim at a target attached to a shaky box. A need exists for an easily transported and placed target holder that is fabricated out of a material that permits quick replacement should damage occur to the frame when bullets inadvertently hit the target frame structure.

SUMMARY OF THE INVENTION

It is an object of the present invention to provide a firearm target support that may be easily disassembled, transported, and re-assembled during its cycle of use. It is a further object of the present invention to provide such a support in a material that is of sufficient rigidity and strength to create a stable target zone having the ability to absorb impacts of errant bullets.

In this regard, a wooden frame structure is provided having a lower support frame and an upper target frame. Removable footings are attachable to the support frame and are stored within the target frame during transport and storage. A replaceable target is received within the target frame, and can easily be replaced as needed during use. Where vertical variance of the target height is required, an inner target frame is slidably received within the primary target frame, and can be extended from such frame in a stabilized manner to place the target above the primary supporting framework.

Use of wood in the target frame structure provides the required strength and rigidity, while also permitting easy repair or replacement when individual wooden members are damaged during use. When configured for storage or transport, the footings are removed from their attachment points on the lower support frame, and are attached to opposed inner walls of the inner target frame, which itself is received by and secured within the primary target frame.

Some further objects and advantages of the present invention shall become apparent from the ensuing description and as illustrated in the accompanying drawings.

DETAILED DESCRIPTION OF THE PREFERRED EMBODIMENTS

Figure 1:
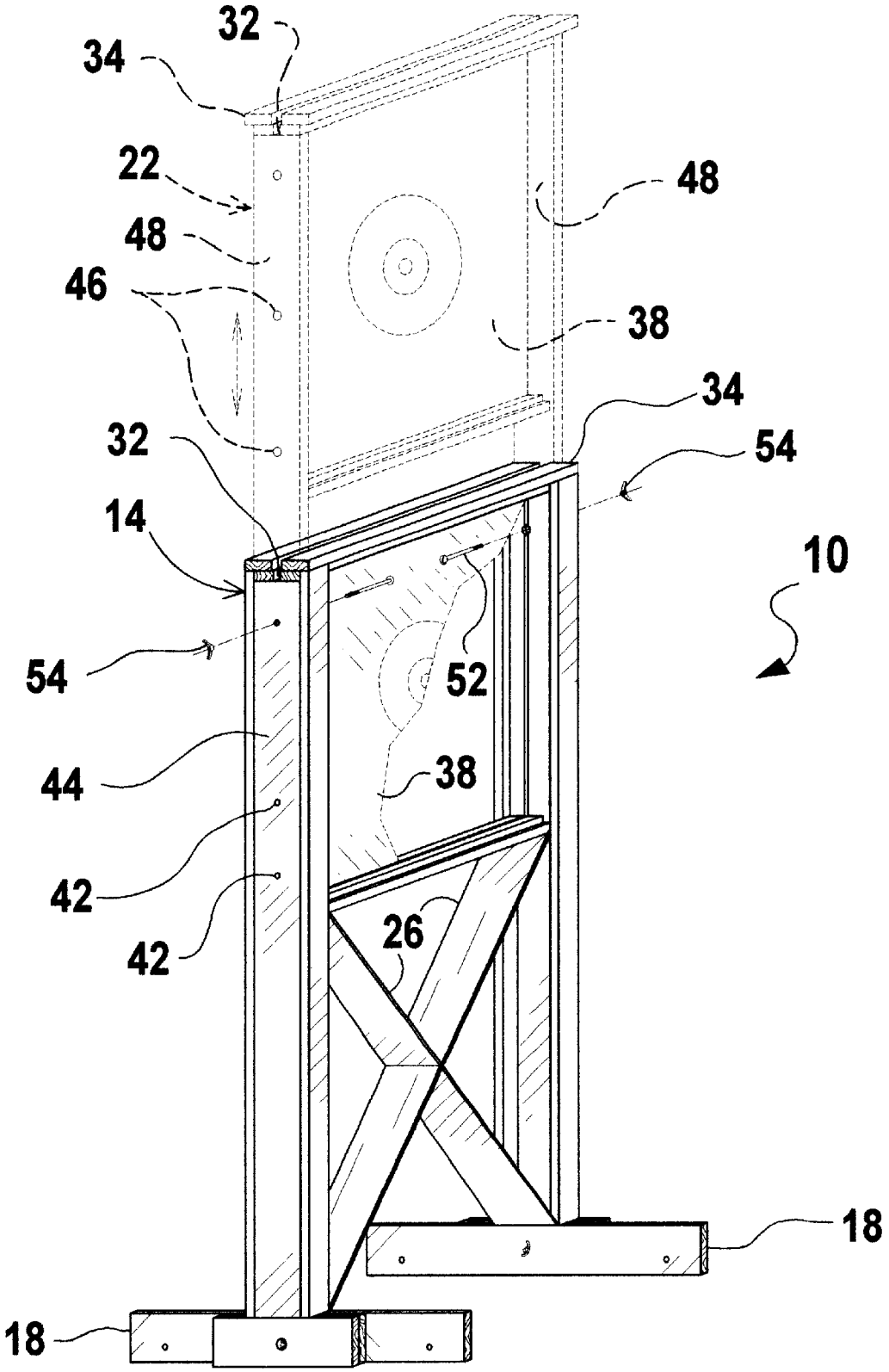
FIG. 1 is a perspective view, with portions in phantom, showing a portable target in accordance with the present invention.

Reference is now made to the drawings wherein like numerals refer to like parts throughout. A target holder 10 is shown in FIG. 1, having an outer support frame 14 that is releasably received in a pair of detachable support footings 18. An adjustable target frame 22 is slidably received within an upper portion of the support frame 10, and a pair of cross support members 26 is attached to and provides structural rigidity to a lower portion of the support frame 10.

An entry slot 32 is formed in a top frame member 34 of the adjustable target frame 22, enabling the easy insertion and removal of a replaceable target 38 that is held in position within the target frame 22 during use. Positioning of the adjustable target frame 22 at varying vertical elevations relative to the support frame 14 is provided using a plurality of vertical adjustment holes 42 formed in an opposing pair of side frame members 44 (only one shown in FIG. 1). A corresponding plurality of side support holes 46 are formed in an opposing pair of side target frame members 48.

At certain preselected elevations, at least one of the opposing pair of vertical adjustment holes 42 and the opposing pair of side support holes 46 pair align, permitting a threaded pin 52 to be received therein, thus maintaining such registration as long as desired. A pair of threaded nuts 54, such as the wing nuts depicted in the Figures, are each received by a respective one of said pair of threaded pins 52, further securing their position within the vertical adjustment and side support holes 42, 46. Removal of the threaded nuts 54, followed by removal of the treaded pins 52 permit changing the vertical position of the adjustable target frame 22 relative to the support frame 14.

Figure 2:
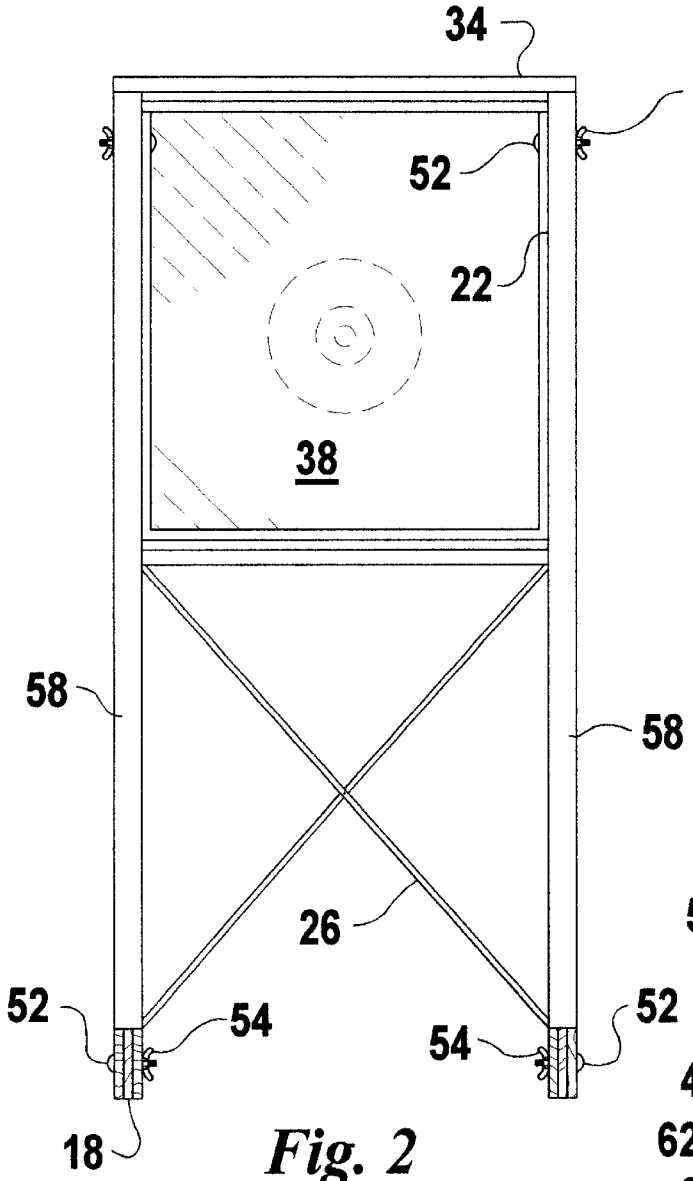
FIG. 2 is a side elevation view, with portions in phantom, showing a portable target in accordance with the present invention.

Turning now to FIG. 2, a slide support trim panel 58 is attached to each lateral edge of the pair of side frame members 44. The slide support trim panels 58 serve as a support and guide for the adjustable target frame 22 when it is received within the support frame 14 of the target holder 10. As is also shown in FIG. 2, the threaded pin 52 and the threaded nuts 54 also are preferably the fastener system used to attach the support footings 18 to the support frame 14.

Figure 3:
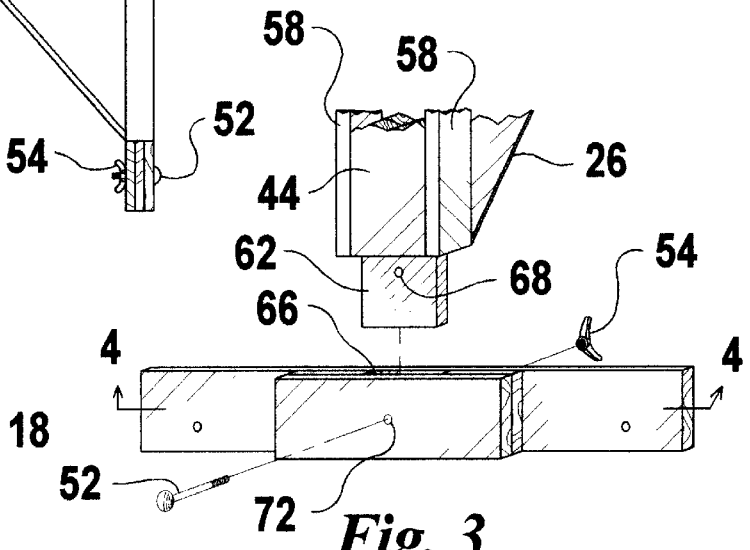
FIG. 3 is a partially-exploded perspective view, showing the manner in which a support footing is attached to a portable target in accordance with the present invention.

As is best shown in FIG. 3, a connection tab 62 is formed as an extension of the inner board of the side frame members 44. A connection slot 66 is formed in the support footing 18 and is configured to slidably receive the connection tab 62 when attachment of the support footing 18 to the support frame 14 is desired. A securement hole 68 is formed in the connection tab 62 at a location appropriate to permit its registration with a tab engagement hole 72 formed in the support footing 18 upon fully receiving the connection tab 62 within the connection slot 66. When so aligned, the threaded pin 52 is inserted into the tab engagement hole 72, and extends through the securement hole 68 of the connection tab 62. Upon its emergence on the opposite side of the support footing 18, the threaded pin 52 is secured by the attachment of the threaded nut 54.

Figure 4:
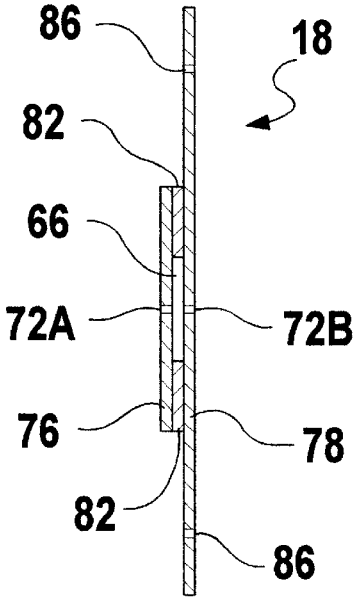
FIG. 4 is a cross-sectional view taken along line 4—4 of FIG. 3, showing a support footing for use with a portable target in accordance with the present invention.

In FIG. 4 a presently preferred construction of the support footing 18 is depicted. A doubler 76 is centrally located along an extended footer board 78. A pair of spacer boards 82 separates and attaches the doubler 76 to the footer board 78, forming the connection slots 66 therebetween. The tab engagement hole 72A, 72B passes through both the doubler 76 and the footer board 78, enabling the threaded pin 52 (not shown in FIG. 4) to extend entirely through the support footing 18. A pair of storage securement holes 86 are formed in the footer board 78 spaced from opposing ends thereof. As will be discussed hereinafter, the pair of storage securement holes 86 is used to attach each of the support footings 18 to one of the side frame members 44 of the support frame 14 during storage.

Figure 5:
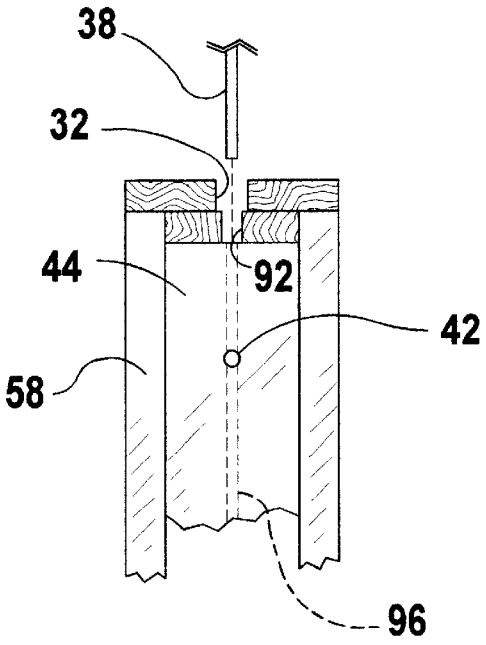
FIG. 5 is a partial end view, with portions in phantom, showing the manner in which a target is received within the portable target holder in accordance with the present invention.
Figure 6:
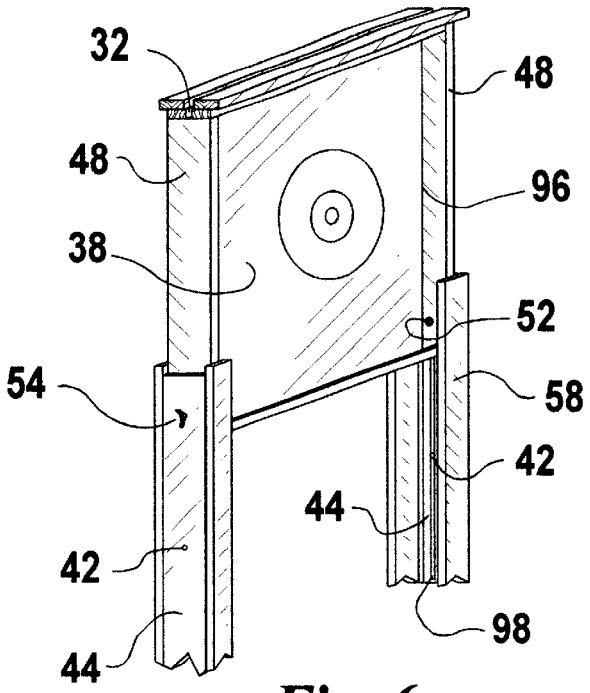
FIG. 6 is a partial perspective view showing placement of a portable target holder within a target holding frame in accordance with the present invention.

FIGS. 5 and 6 illustrate the manner in which the replaceable target 38 is received within the adjustable target frame 22. Turning first to FIG. 5, a narrowed receiving slot 92 is located immediately inside of the entry slot 32. The juxtaposition of these two slots is intended to form a funnel-like structure to assist in the receiving of the replaceable target 38 within the target frame 22, as well as to help direct the leading edge of the replaceable target 38 into slidable inter-engagement with the target frame 22.

A retaining slot 96 is formed in each of the pair of side panels 48 of the adjustable target frame 22 (only one shown in FIG. 6). The use of the pairs of threaded pins 52 and threaded nuts 54 to secure the positioning of the adjustable target frame 22 with respect to the side frame members 44 of the outer support frame 14 is also shown in FIG. 6, as is a presently preferred optional side frame notch 98, the utility of which is discussed hereinafter in the context of FIGS. 8 and 9.

Figure 7:
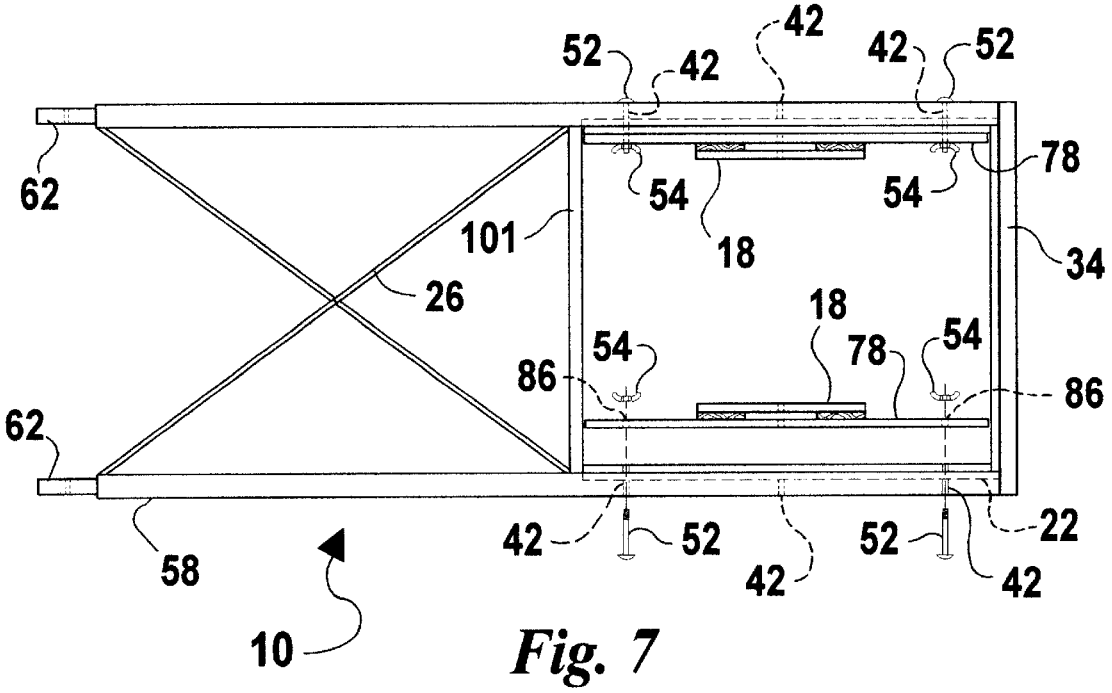
FIG. 7 is a partially exploded plan view, with portions in phantom, showing attachment of the support footings to the support frame during storage of a portable target in accordance with the present invention.

In FIG. 7, the target holder 10 is being readied for storage and/or transport. The pair of support footings 18 are shown as having been removed from their respective connection tabs 62 for attachment to one of the side frame members 48 forming a lateral side of the adjustable target frame 22. The support footing 18 is placed against one of the side target frame members 48 in a manner causing the registration of the pair of storage securement holes 86 formed on the footer board 78 of the support footing 18 and the vertical adjustment holes 42 located on the side target frame members 48 of the adjustable target frame 22.

Upon the occurrence of such registration, a pair of threaded pins 52 is placed within the thus-aligned storage securement holes 86 and the vertical adjustment holes 42. As previously the case, the threaded pins 52 are secured within the registered holes by use of the threaded nuts 54.

As is also shown in FIG. 7, a central support board 101 is attached to and extends between opposite side frame members 44 of the support frame 14 immediately adjacent to the upper ends of the cross support members 26. The central support board 101 provides additional stability and strength.

Figures 8, 9:
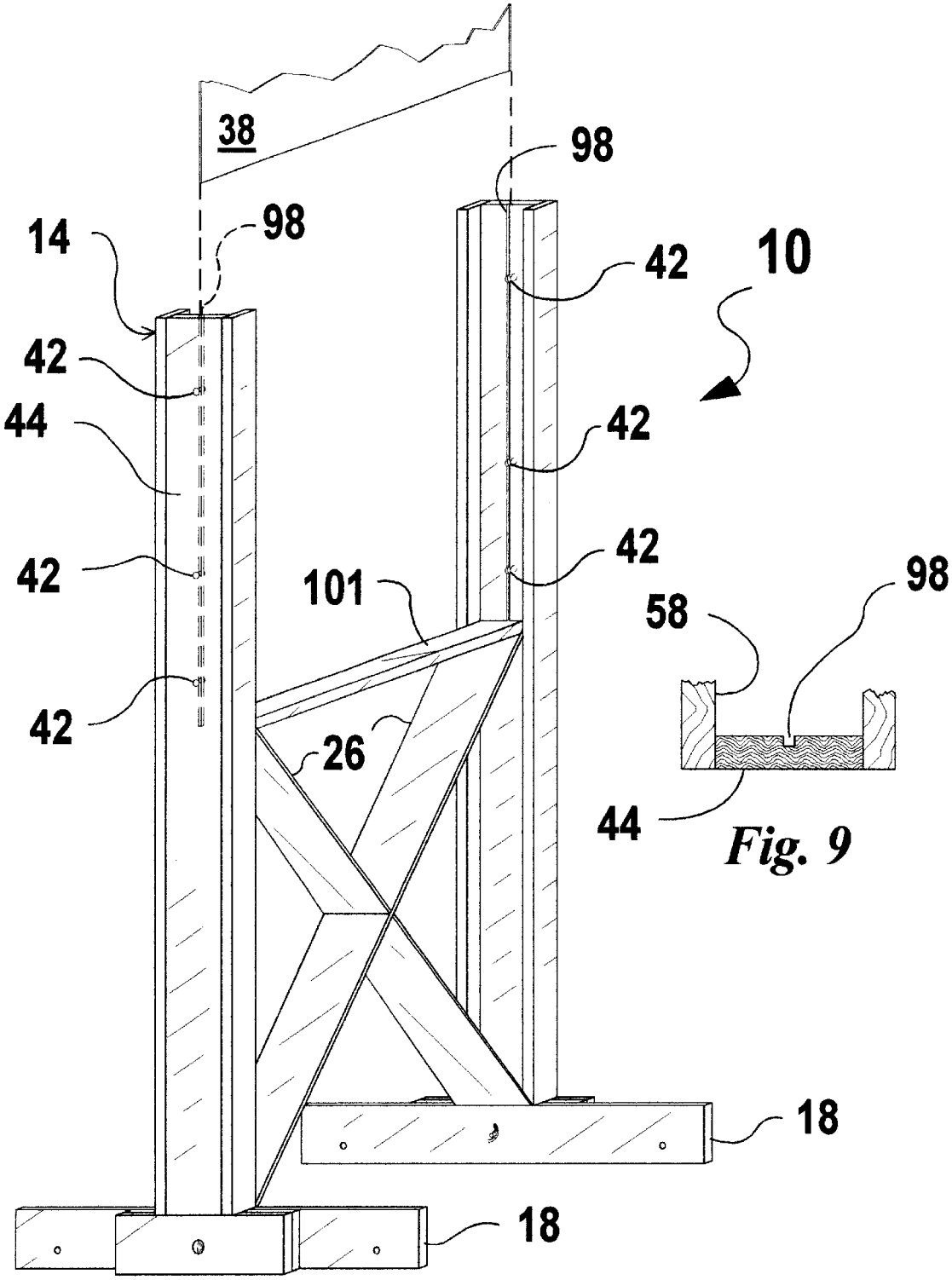
FIG. 8 is a partial perspective view, with portions in phantom, showing an alternative manner of placing a target directly in a target holding frame in accordance with the present invention.
FIG. 9 is a partial top plan view showing an end of a support frame in accordance with the present invention.

FIG. 8 illustrates a presently preferred alternative embodiment, which permits the use of the replaceable target 38 without the adjustable target frame 22. As is briefly discussed in the context of FIG. 6, the side frame members 44 of the support frame 14 are each provided with the centrally located side frame notch 98 (see also FIG. 9). With the adjustable target frame 22 removed from the support frame 14, the opposed pair of side frame notches 98 are positioned to slidably receive the appropriately dimensioned replaceable target 38. The central support board 101 provides a support floor upon which the replaceable target 38 can rest while held within the opposed pair of side frame notches 98. After sustaining projectile damage, replacement of the target 38 is easily accomplished by its slidable removal from the side frame notches 98 of the side frame members 44.

In a presently preferred embodiment, the target holder 10 is fabricated out of 1" by 2" and 1" by 4" boards of wood such as redwood and clear pine, wood screws, ¼" carriage bolts, and wing nuts. The dimensions of the support frame 14 are preferably 47½" high by 23" wide by 5" thick. As so dimensioned, a suitably-sized adjustable target frame measures 24" high by 18" wide, permitting the target held within to be adjusted from 48" high to 67" in height.

The retaining slot 96 is preferably ¼" which is sufficient to slidably retain a target formed out of a standard cardboard material (⅛"–3⁄16"). As noted previously, the entry slot 32 at ⅝" is slightly larger than the ½" of the narrowed receiving slot 92 located below. Both of these measurements are greater than the retaining slot 96 (¼"), which permits the easy removal of the target after use, notwithstanding the "expansion" damage caused by the bullet impacts.

The side frame members 44 are fabricated out of two 1" by 4" boards screwed together, with a 1" by 2" board used to form the slide support trim panels 58 located along each lateral edge of the two-board construction (side frame members 44). Along the upper portion of the support frame 14, the slide support trim panels 58 form the receiving track for the target frame 22, permitting its sliding adjustment over the several fixed adjustment positions created by the location of the vertical adjustment holes 42. The side frame notches

98 consist of a ¼" by ¼" slot formed in the side frame members 44. The sides of the support frame 14 are held together by one 1" by 4" board attached to form the central support board 101 and two 1" by 4" boards that cross at 45-degree angles to form the cross support members 26.

The target frame 22 is fabricated out of three 1" by 4" boards with a central ¼" slot extending along all of the boards to create the retaining slot 96. The top is constructed from two 1" by 2" boards that are separated ½" to form the receiving slot opening.

The support footings 18 are constructed out of four pieces of 1" by 4" board, with each support footing 18 having four separate wood pieces, the longer footer board 78 being 23½" long, the doubler is 10½", and two boards that are 3½" long create the spacer boards. The resulting connection slot 66 created upon the assembly of these four component boards has a preferred width and thickness of 3⅝" by ¾".

My invention has been disclosed in terms of a preferred embodiment thereof, which provides an improved target holder that is of great novelty and utility. Various changes, modifications, and alterations in the teachings of the present invention may be contemplated by those skilled in the art without departing from the intended spirit and scope thereof. It is intended that the present invention encompass such changes and modifications.

I claim:

1. A firearm target support comprising:

a support frame having a pair of spaced-apart vertical members;

a pair of support footings, each removably attachable to a base end of one of said pair of spaced-apart vertical members, said pair of support footings projecting fore and aft of a plane containing said vertical members when attached to their respective base ends;

a plurality of attachment members received along at least one linear portion of said support frame selectively retaining each of said pair of support footings in a position substantially parallel to said support frame during periods of transport and storage of said firearm target support;

a target frame slidably received between said pair of spaced-apart vertical members; and a plurality of vertical positioning members attaching said target frame to each of said pair of spaced-apart vertical members at selected vertical positions relative thereto.

2. A target support according to claim 1, wherein said target frame is of a box frame construction.

3. A target support according to claim 2, wherein said box frame construction includes a pair of side frame members having inner surfaces, each of said inner surfaces having a target retaining slot centrally formed therein.

4. A target support according to claim 3, wherein said box frame construction further includes a top frame member having a centrally located entry slot formed therein, said entry slot and said opposed pair of target retaining slots cooperatively located in such a manner as to selectively receive a replaceable target and removably retain said target within said target frame.

5. A target support according to claim 2, and further comprising a cross-member attached to each of said spaced-apart vertical members and extending therebetween, said cross-member having a support surface, whereby a lower frame member of said target frame rests upon said support surface of said cross-member when said target frame is in a lowered position relative to said pair of spaced-apart vertical members.

6. A target support according to claim 5, and further comprising a replaceable target selectively received by and retained within said opposed pair of target retaining slots formed in said target frame.

* * * * *